US005730431A

United States Patent [19]

Cattini

[11] Patent Number: 5,730,431

[45] Date of Patent: Mar. 24, 1998

[54] MODULAR SUCTION BLOCK

[75] Inventor: Flavio Cattini, Bergamo, Italy

[73] Assignee: F.K. Systema S.r.l., Dalmine, Italy

[21] Appl. No.: 577,752

[22] Filed: Dec. 22, 1995

[30] Foreign Application Priority Data

Nov. 13, 1995 [IT] Italy ..... BS95A0095

[51] Int. Cl.[6] ..... B25B 11/00

[52] U.S. Cl. ..... 269/21; 269/289 R; 269/47; 269/311; 269/54.4; 83/152; 83/451; 83/941

[58] Field of Search ..... 269/21, 47, 53, 269/311, 54.4, 54.5, 289 R, 296, 303, 305, 309; 83/152, 409, 451, 658, 941

[56] References Cited

U.S. PATENT DOCUMENTS

| | | | |
|---|---|---|---|
| 4,205,835 | 6/1980 | Gerber | 269/21 |
| 4,685,363 | 8/1987 | Gerber | 269/53 |
| 5,110,239 | 5/1992 | Riley et al. | 269/21 |
| 5,189,936 | 3/1993 | Gerber et al. | 83/409 |
| 5,358,226 | 10/1994 | Arikita | 296/21 |

*Primary Examiner*—Timothy V. Eley
*Assistant Examiner*—Lee Wilson
*Attorney, Agent, or Firm*—McGlew and Tuttle

[57] ABSTRACT

The present invention pertains to a modular block for the formation of suction surfaces in machines for the cutting of fabrics with a free blade with alternating movement. The block includes a first base element having structure for its installation and a second complete element having a plurality of bristles perpendicular to it. The two elements are superimposed and are attached firmly to one another. The two elements combined define lateral openings in the direction at right angles to the base of the bristles and are able to be connected to a suction apparatus for the formation of the vacuum among the bristles.

4 Claims, 3 Drawing Sheets

MODULAR SUCTION BLOCK

FIELD OF THE INVENTION

The present invention pertains, in general, to suction surfaces in machines for cutting fabrics, and more specifically, it pertains to a modular block for the formation of a suction surface, which is intended for supporting and holding fabric laps, while this fabric is cut with a free blade with alternating movement, which operates perpendicular to and penetrates the suction surface.

BACKGROUND OF THE INVENTION

On the one hand, machines for the cutting of superimposed laps of fabric by means of a free blade with alternating movement are well known. Such machines are usually equipped with a suction surface on which the fabric is stretched, supported and held for cutting, and which the blade must be able to penetrate, without difficulties, by passing through the fabric. A suction apparatus is connected to the suction surface in such a manner that a vacuum is generated up to its surface in order to hold the fabric supported there.

On the other hand, suction surfaces are known for such machines, which comprise single blocks of bristles placed side by side in order to form a bed of bristles, among which the vacuum is generated, and the free cutting blade is able to penetrate and to move in a translatory manner without difficulties.

In a known embodiment, each single block of bristles is made of a plastic material and has a base, which, on the bottom, has feet for its installation, and on its top, a plurality of bristles, which are parallel, flexible, and are all connected to the base itself. The bristles are essentially conical, and their free ends define a planar surface or bed for holding and supporting the fabric.

In the base there are provided through-holes, which open above and between the bristles and which, below, communicate with a suction chamber, to which the suction apparatus is connected.

Therefore, vacuum is applied to the bed of bristles underneath the single blocks via the through-holes in the bases of the blocks themselves. However, the suction underneath the blocks, even if it permits a uniform distribution of the vacuum among the bristles, may lead to a probable blocking of the holes in the bases of the blocks due to fine dust and filaments passing among the bristles. A blast of air, which is obtained, e.g., by inverting the suction flow, may not be sufficient to unblock the holes when they are blocked.

SUMMARY AND OBJECTS OF THE INVENTION

One object of the present invention is to provide a block of bristles for the formation of a suction surface in machines of the above-mentioned type, which element or block is not monolithic, but comprises at least two combined complementary elements and in which the pressure drop for the vacuum is applied not under but from the sides of the block of bristles.

Another object of the present invention is to provide a suction surface for the above-mentioned machines for cutting fabric, which suction surface comprises a plurality of single blocks, which are set side by side and each of which comprises two combined elements, and in which surface the drop in pressure for the vacuum is applied externally and is generated centrally via transverse paths through the bristles.

Another object of the present invention is to propose a suction surface comprising a plurality of single blocks of bristles without the limitations due to blocking and due to the difficulty of cleaning the suction surfaces of the known type.

According to the invention, a modular block for the formation of suction surfaces is provided in a machine for cutting fabrics with a free blade with alternating movement. A first base element is provided having means for its installation or mounting and a second complete element is provided having a plurality of bristles perpendicular thereto. The first element and the second element are superimposed and attach firmly to one another. The first element and the second element combined define lateral openings which are in a direction at right angles to a base of the bristles. A suction apparatus is connected to the openings for the formation of a vacuum among the bristles.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
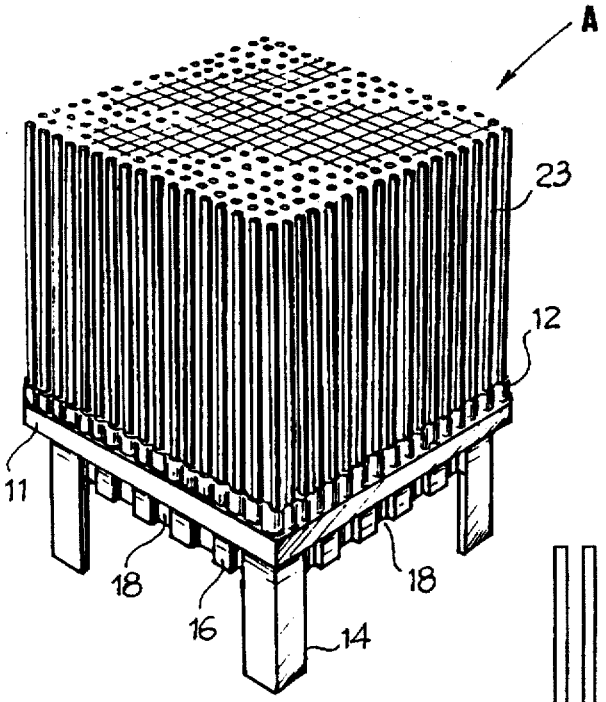
FIG. 1 is a perspective view showing a complete block of bristles.

Referring to the drawings in particular, a block A is provided comprising two elements: a first base element 11 and a second bristle-carrying element 12, which are obtained separately and then connected and joined with one another.

The base element 11 comprises a horizontal wall 13, feet 14 and coupling means 15, which extend towards the lower part of the horizontal wall 13, a vertical outer wall 16, which extends towards the top of the horizontal wall 13, and an edge 17 at the top of the vertical wall 16, which protrudes towards the outside. Openings 18 are provided in the outer wall 16, between the upper edge 17 and the horizontal wall.

The second bristle-carrying element 12 has a horizontal wall 19 as well, from which a vertical outer wall 20 extends towards the top, ending, at the top, with a bracket edge 21, which protrudes towards the outside. The openings 22, which are similar to the openings 18 of the first base element, are provided in the outer wall 20. All the bristles 23*a*, whose free ends 23' are of equal height, i.e., complanate, extend from the upper surfaces of the horizontal wall 19 and of the bracket edge 21 of the second element 12.

Figure 2:
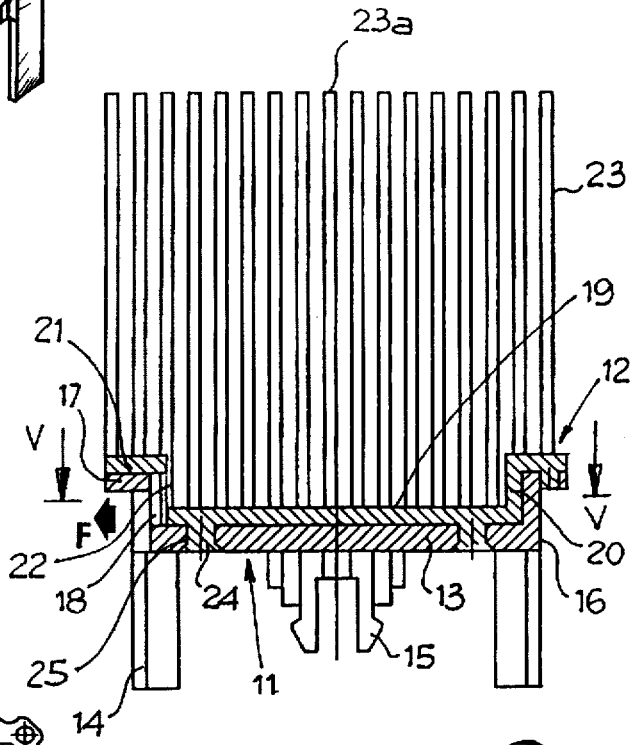
FIG. 2 is a vertical cross sectional of the block in FIG. 1.
Figure 3:
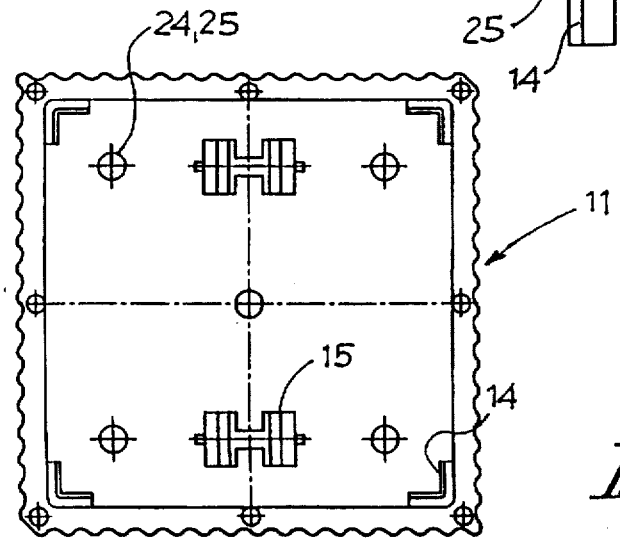
FIG. 3 is a view of the block from the bottom.
Figure 5:
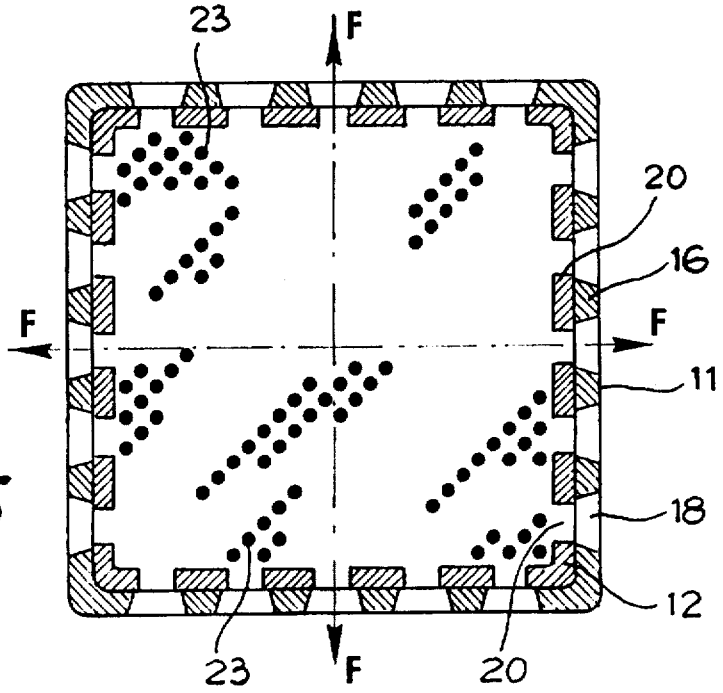
FIG. 5 is a sectional view according to the line V—V in FIG. 2.
Figure 4:
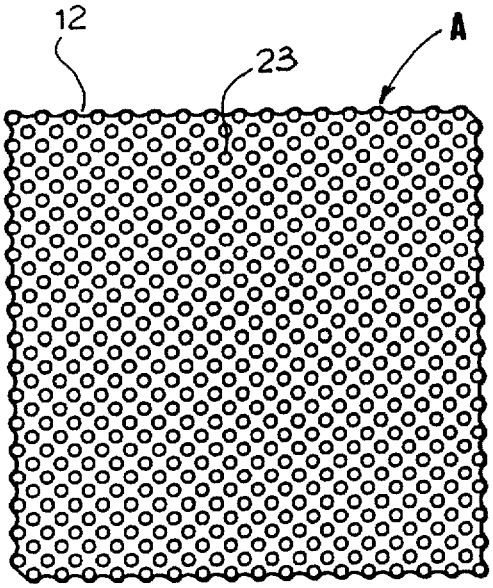
FIG. 4 is a view of the block from the top.

The second element 12 is dimensioned so as to be superimposed on the base element 11. More specifically, the horizontal wall 19 and the outer wall 20 of the second element 12 are arranged in the first element 11, resting against the inner surfaces of the horizontal wall 13 and against the inner surfaces of the outer wall 20 of the first element 11, respectively. The bracket edge 21 of the second element 12 rests on the upper edge 17 of the base element, and the lateral openings 18 and 22 of the two elements 11, 12 coincide with each other as shown in FIGS. 2 and 5.

The two elements are joined by means of connecting pegs 24 which are provided on one element, e.g., the second element, and intended for engaging tightly in corresponding holes 25 provided in the other element, e.g., the first element. Moreover, the fixation of the two elements may also be obtained with other means, e.g., by means of an adhesive, welding or the like.

Figure 6:
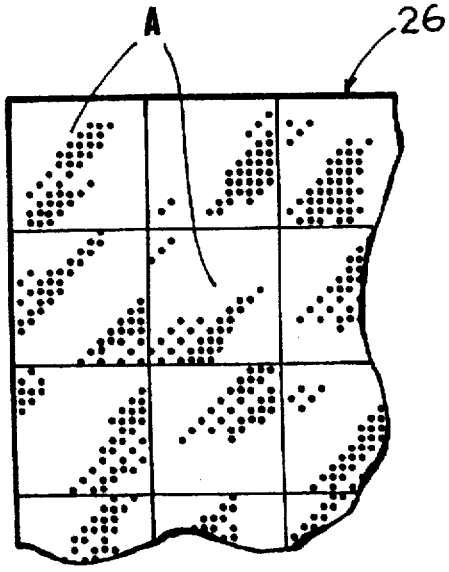
FIG. 6 is a sectional view of a suction surface comprising several blocks set side by side.

The two assembled elements 11, 12 form a block, which carries the bristles and which is closed at the base and has openings in all the outer sides. The block may be installed or mounted on an appropriate support by mounting means including the feet 14 and basic coupling means 15, side by side with other identical blocks, in order to form a suction surface 26, one section of which is shown in FIG. 6. Therefore, this surface defines a bed of bristles for the support of the material to be held and to be cut, and a suction apparatus is connected to the surface to create the vacuum among the bristles from the sides according to the arrows F through the lateral openings 18, 22, which put all the assembled blocks in contact with one another.

Figure 7A:
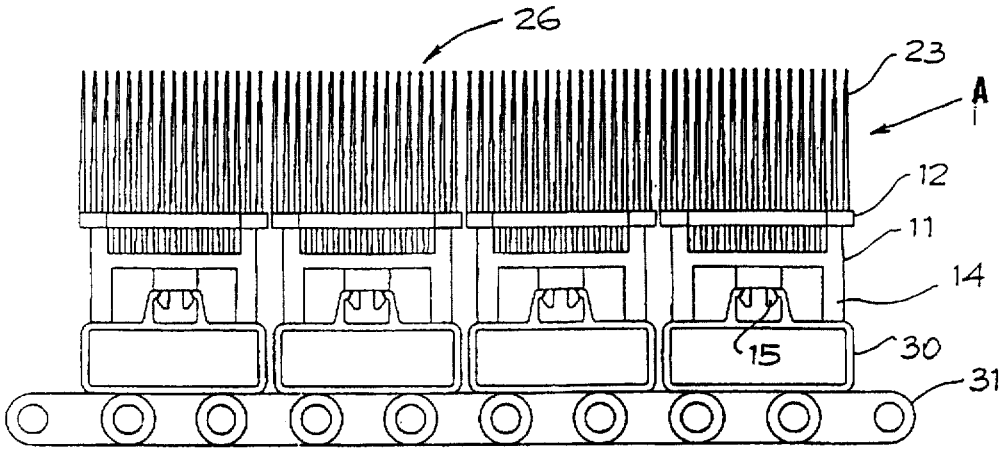
FIG. 7A is a sectional view of the Modular block A.
Figure 7B:
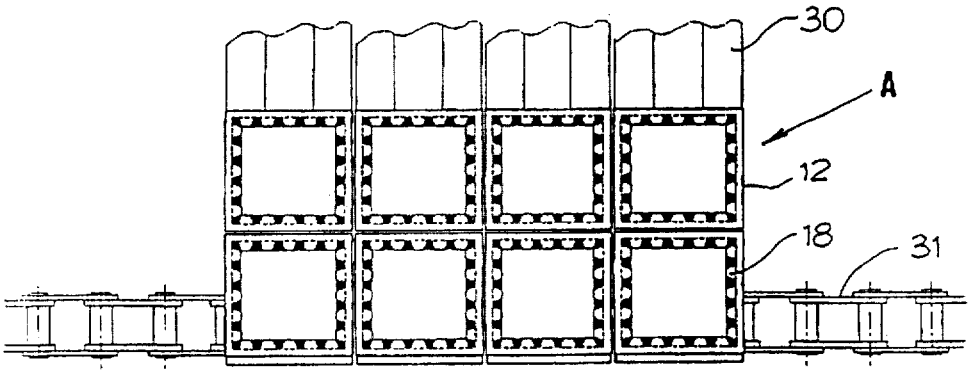
FIG. 7B is a top view of the Modular block A.
Figure 7C:
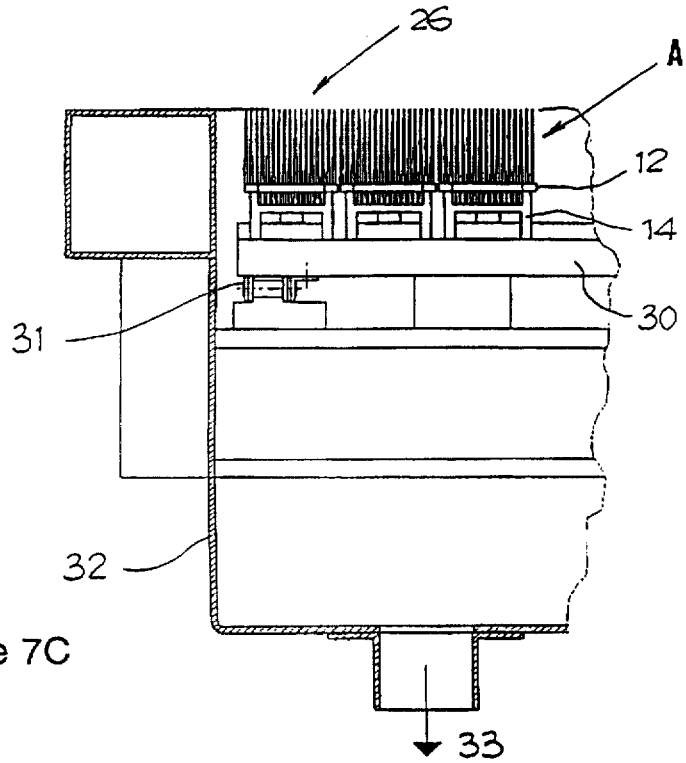
FIG. 7C is a sectional view of the enclosed peripherally in the tank of Modular block A.

FIG. 7A illustrates the insulation means as well as the suction means. Modular block A forms a suction surface 26. FIG. 7B illustrates the top of the Modular block A attached to the chain and the top of the suction surface. A plurality of blocks A are mounted on the cross-pieces 30, which is supported by chains 31 (see lower part of FIG. 7A). A plurality of cross-pieces with blocks A form the suction surface 26. The plurality of blocks A are mounted on the cross-piece 30, which is supported by the chains 31. A plurality of cross-pieces with blocks A form the suction surface 26. The entire unit is arranged above and is enclosed peripherally in a tank 32 (see FIG. 7C). The suction apparatus 33 is connected to the tank 32.

While specific embodiments of the invention have been shown and described in detail to illustrate the application of the principles of the invention, it will be understood that the invention may be embodied otherwise without departing from such principles.

What is claimed is:

1. A modular block for the formation of suction surfaces in a machine for the cutting of fabrics with a free blade with alternating movement, comprising:

a first base element having mounting means for mounting of the modular block in the machine, said first element including:

a horizontal wall;

feet and a coupling element forming part of said mounting means, said feet and said coupling element extending downwardly from a lower pan of said horizontal wall;

a vertical outer wall extending upwardly from a top of said horizontal wall and ending at a vertical outer wall top with an edge protruding towards an outside; and said lateral openings being provided in said outer wall between the said horizontal wall and the said upper edge;

a second element having a plurality of bristles disposed perpendicular to said second element, said second element being superimposed on said first element, said first element and said second element being attached firmly to one another and combined to define lateral openings in a direction at right angles to said bristles, whereby a suction apparatus is connected to said openings for formation of a vacuum among the bristles, and said second element comprises:

a second element horizontal wall;

a second element vertical outer wall, which rises from said second element horizontal wall and which ends, at a top, with a bracket edge, which protrudes towards the outside;

said lateral openings being provided in said second element vertical outer wall between said second element horizontal wall and said bracket edge of the said second element; and said plurality of bristles, which rise from the upper surfaces of the said horizontal wall and of the said bracket edge, with free ends of said bristles being complanate and said second element being connected to said first element in such a manner that:

said second element horizontal wall rests on said horizontal wall of the said first element;

said second element vertical outer wall rests against said inner surface of the said outer wall of the said first element;

said bracket edge of said second element rests on said edge of said first element; and said lateral openings of said two elements correspond to form a passage through said two elements.

2. A block in accordance with claim 1, in which said first and said second element, when they are superimposed, are attached to one another by one of a mechanical connection, with an adhesive, and by welding.

3. A suction surface for machines for the cutting of fabric with a free blade with alternating movement, comprising:

a plurality of identical blocks set next to one another, each block including a first base element having mounting means for mounting of said block in a machine, said each block including a second element having a plurality of bristles disposed perpendicular to said second element, said second element being superimposed on said first element and said first element, said second element being attached firmly to one another and combined to define lateral openings; opening in a direction at right angles to said plurality of bristles, said first base element comprises:

a horizontal wall;

feet and a coupling element forming part of said mounting means, said feet and said coupling element extending downwardly from a lower part of said horizontal wall;

a vertical outer wail extending upwardly from a top of said horizontal wall and ending at a vertical outer wall top with an edge protruding towards an outside; and said lateral openings being provided in said outer wall between the said horizontal wall and the said upper edge;

and said second element comprises:

a second element horizontal wall;

a second element vertical outer wall, which rises from said second element horizontal wall and which ends, at a top, with a bracket edge, which protrudes towards the outside;

said lateral openings being provided in said second element vertical outer wall between said second element horizontal wall and said bracket edge of the said second element; and said plurality of bristles, which rise from the upper surfaces of the said horizontal wall and of the said bracket edge, with free ends of said bristles being complanate and said second element being connected to said first element in such a manner that:

said second element horizontal wall rests on said horizontal wall of the said first element;

said second element vertical outer wall rests against said inner surface of the said outer wall of the said first element;

said bracket edge of said second element rests on said edge of said first element; and said lateral openings of said two elements correspond to form a passage through said two elements;

a suction apparatus, which is applied to the surface in order to create the vacuum among said bristles with a suction carried out through said lateral openings of said blocks in a direction perpendicular to said bristles.

4. A suction surface in accordance with claim 3, in which said first and said second element, when they are superimposed, are attached to one another by one of a mechanical connection, with an adhesive, and by welding.

* * * * *